US005424029A

United States Patent [19]

Kennedy et al.

[11] Patent Number: 5,424,029

[45] Date of Patent: Jun. 13, 1995

[54] CORROSION RESISTANT NICKEL BASE ALLOY

[75] Inventors: Richard L. Kennedy, Monroe, N.C.; Ronald J. Gerlock, Lockport, N.Y.; Clarence G. Bieber, deceased, late of Proctorville, Ohio, by Judith R. Nelson, legal representative

[73] Assignee: Teledyne Industries, Inc., Los Angeles, Calif.

[21] Appl. No.: 107,030

[22] Filed: Aug. 17, 1993

Related U.S. Application Data

[63] Continuation of Ser. No. 161,943, Feb. 29, 1988, abandoned, which is a continuation-in-part of Ser. No. 365,779, Apr. 5, 1982, abandoned.

[51] Int. Cl.[6] ..... C22C 19/05

[52] U.S. Cl. ..... 420/442; 420/453; 420/448

[58] Field of Search ..... 420/442, 445, 446, 448, 420/451, 427, 428, 453

[56] References Cited

U.S. PATENT DOCUMENTS

| | | | |
|---|---|---|---|
| 2,392,821 | 1/1946 | Kreag | 420/442 |
| 3,918,964 | 11/1975 | Baldwin et al. | 420/442 |
| 4,246,048 | 1/1981 | Kawai et al. | 148/427 |
| 4,410,489 | 10/1983 | Asphahani | 420/453 |
| 4,476,091 | 10/1984 | Klarstrom | 420/443 |
| 4,533,414 | 8/1985 | Asphahani | 148/427 |

FOREIGN PATENT DOCUMENTS 1210607 10/1970 United Kingdom .

1288215 9/1972 United Kingdom .

OTHER PUBLICATIONS

Corrosion of Nickel-Base Alloys-D. F. Bickford & R. A. Corbett Oct. 23-25, 1984-Int. Conf. on Corrosion of Nickel-Base Alloys, pp. 59-67.

A Comparison of Corrosion Resistant Alloys in Severe Environments R. J. Gerlock & D. T. Manolakos-Mar. 25-29, 1985; Corrosion 85; pp. 166/1-166/11.

Corrosion Evaluation of Alloys for Nuclear Waste Processing-R. A. Corbett, D. F. Bickford, W. S. Morison Corrosion/86 Conference.

High Nickel, Chromium-Molybdenum Alloys-Are some New Alloys More Corrosion Resistant than the Old-R. A. Corbett & W. S. Morrison Mar. 21-25, 1988 Corrosion/88 Conference.

*Primary Examiner*—Deborah Yee

*Attorney, Agent, or Firm*—Beveridge, DeGrandi, Weilacher & Young

[57] ABSTRACT

A nickel base alloy is provided having excellent hot and cold workability and superior corrosion resistance to a variety of media including deep sour gas well environments and highly corrosive oxidizing environments. The alloy consists essentially of, by weight, about 27 to 33% chromium, about 8 to 12% molybdenum, about 1 to 4% tungsten, and the balance nickel. The alloy may also contain as impurities or as additions, up to about 1.5% iron, up to about 0.15% carbon, up to about 1% aluminum, up to about 1% titanium and up to about 2% columbium.

15 Claims, No Drawings

CORROSION RESISTANT NICKEL BASE ALLOY

This application is a continuation of application No. 07/161,943, filed Feb. 29, 1988, now abandoned, which application is entirely incorporated herein by reference, which is a continuation-in-part of applicants' pending application Ser. No. 365,779, filed Apr. 5, 1982 now abandoned.

This invention relates to a corrosion resistant nickel base alloy, and more particularly to an improved hot and cold workable nickel base alloy which has excellent corrosion resistance under a broad range of corrosive conditions, and which is particularly suited for use in highly corrosive deep sour gas well applications and in highly corrosive oxidizing environments.

Many of the alloys used commercially in applications requiring good corrosion resistance are nickel base alloys. Such alloys generally contain relatively large amounts of chromium and molybdenum, and usually also contain substantial proportions of iron, copper or cobalt. Alloy C-276 for example, a well known corrosion resistant nickel base alloy used in a variety of corrosive applications, has a nominal composition of about 15.5% cbromium, 15.5% molybdenum, 3.5% tungsten, 6% iron, 2% cobalt and the balance nickel. Other known corrosion resistant alloys include Alloy B-2, which has a nominal composition of about 28% molybdenum, 1% chromium, 2% iron, 1% cobalt, and the balance nickel; Alloy 625, which contains about 21.5% chromium, 9% molybdenum, 4% iron, 3.6% columbium, and the balance nickel; and Alloy 718, which contains about 19% chromium, 3% molybdenum, 19% iron, 5.1% columbium, and the balance nickel.

Perhaps one of the most severely corrosive environments for a corrosion resistant nickel base alloy is found in deep sour gas well operations, where casing, tubing and other well components are subjected to high concentrations of hot wet hydrogen sulfide, brine and carbon dioxide under conditions of high temperature and pressure. Heretofore, the industry has relied on commercially available corrosion resistant nickel base alloys such as those noted above, which were developed for other, less severe applications. However, these alloys have been less than fully satisfactory in the severe conditions found in sour gas well operations and in other highly corrosive oxidizing environments. While certain alloys having high corrosion resistance have been developed, such alloys are high in cobalt, and are therefore significantly more costly.

We have now discovered a nickel base alloy having outstanding corrosion resistance over a broad range of corrosive conditions ranging from oxidizing conditions to reducing conditions, and which performs particularly well in tests designed to simulate the extremely severe corrosive environment found in deep sour gas well operations and also in other highly corrosive oxidizing environments. Additionally, this alloy exhibits excellent hot and cold workability, is weldable and has a relatively low content of expensive alloying elements. The alloys of this invention can be made into bars, wires, billets, ingots, tubes, pipes, sheet and plate and because of their extreme effectiveness against corrosion, can also be used in chemical and petro-chemical processing, flue gas scrubbers, pulp and paper processing and a wide range of other critical applications.

These and other advantageous properties are obtained in accordance with the present invention in a nickel base. alloy having a critical balance of chromium, molybdenum, and tungsten within the following weight percentage ranges:

| | |
|---|---|
| Chromium | about 27–33 |
| Molybdenum | about 8–12 |
| Tungsten | about 1–4 |
| Nickel | Balance |

Nickel base alloys having this critical balance of chromium, molybdenum and tungsten exhibit superior corrosion resistance in a variety of solutions when compared to other commercially available corrosion resistant alloys, including Alloy C-276, Alloy B-2, Alloy 718 and Alloy 625. Further, based upon the cost of the metals contained therein, alloys in accordance with this invention are less expensive than certain other commercial nickel base alloys which have poorer corrosion resistance. Alloys of the invention are easily hot workable so that they can be formed into various desired shapes, and also exhibit excellent cold workability so that high strength can be imparted to the final product by cold working.

In carrying the invention into practice, advantageous results are obtained when the alloy consists essentially of about 27–33% chromium, about 8–12% molybdenum, about 1–4% tungsten, and the balance nickel. In a preferred embodiment of the invention the alloy consists essentially of about 29–33% chromium, about 9–11% molybdenum, about 1–3% tungsten and the balance nickel. In the more preferred embodiment of the invention the alloy consists essentially of about 31–32% chromium, about 9–10% molybdenum, 2–3% tungsten and the remainder being nickel. By the term "consisting essentially of" we mean that in addition to the elements recited, the alloy may also contain incidental impurities and additions of other unspecified elements which do not materially affect the basic and novel characteristics of the alloy, particularly the corrosion resistance of the alloy. Such impurities and additions will be discussed further herein.

Chromium is an essential element in the alloy of the present invention because of the added corrosion resistance that it contributes. It,appears from testing that the corrosion resistance is at an optimum when the chromium is at about 31% of the composition. When the chromium is raised above about 33%, both the hot workability and the corrosion resistance worsen. Corrosion resistance also worsens below about 27% chromium.

The presence of molybdenum provides improved pitting corrosion resistance. An optimum content of about 10% molybdenum appears to yield the lowest corrosion rate in the solutions tested. When the molybdenum content is decreased below about 8%, the pitting and crevice corrosion increases significantly. The same occurs when the molybdenum is increased above about 12%, and in addition, the hot and cold workability decrease noticeably.

Tungsten is not generally included in commercial alloys developed for corrosion resistant applications. This element is usually provided in applications where enhanced strength, particularly at high temperature, is of primary concern, and is not generally thought to have any beneficial effect on corrosion resistance. However, in the alloys of this invention, the presence of tungsten has been found to significantly enhance the corrosion resistance. Corrosion testing shows that the absence of tungsten results in a significantly higher corrosion rate, while a tungsten content in excess of about 4% causes the material to corrode at a higher rate in certain solutions, as well as making the alloy more difficult to hot work.

The alloy will normally also contain carbon either as an incidental impurity or as a purposeful addition for forming stable carbides. The carbon level should be no more than about 0.15% by weight of the alloy and preferably should not exceed about 0.08% by weight, and most desirably should not exceed 0.04%.

Cobalt and nickel are generally regarded as being interchangeable and provide similar properties to the alloy. Tests have shown that the substitution of cobalt for a portion of the nickel content does not adversely affect the corrosion resistance and workability characteristics of the alloy. Therefore cobalt may be included in the alloy if desired, even at levels up to about 12% by weight. However, because of the present high cost of cobalt, substitution of cobalt for nickel would not be economically attractive.

Aluminum may be present in small amounts to serve as a deoxidant. However, higher additions of aluminum adversely affect the workability of the alloy. If aluminum is present, it should not exceed an amount of about 1% by weight, and, most desirably, it should not exceed about 0.25%.

Titanium and column may also be present in small amounts to serve as carbide formers. These elements may be included at levels preferably not to exceed about 1% titanium and about 2% columbium, and most desirably, not to exceed about 0.25% titanium and about 0.7% columbium. The addition of significantly larger amounts of these elements, however, has been found to have deleterious effects on hot workability.

Alloys in accordance with this invention may also contain minor amounts of other elements as impurities in the raw materials used to make the alloys or as deliberate additions to improve certain characteristics of the alloys, as is well known in the art. For example, minor proportions of magnesium, cerium, lanthanum, yttrium or Misch metal may be optionally included to contribute to workability. Tests have shown that magnesium can be tolerated up to about 0.10%, and preferably up to about 0.07% without significant loss of corrosion resistance. Boron may be added, preferably up to about 0.005%, to contribute to high temperature strength and ductility. Tantalum may be present at levels up to about 2% without adversely affecting the corrosion resistance or workability, but the presence of tantalum at these levels has not been observed to benefit these properties of the alloy. Similarly vanadium can be present up to about 1% and zirconium up to about 0.1%.

Iron in significant amounts lowers the corrosion resistance of the alloy. Iron, if present, can be tolerated at levels up to about 1.5%, but the corrosion resistance drops quite significantly at higher levels. Copper, manganese, and silicon, when present in small amounts or as impurities, can be tolerated. However, when added in significant amounts as alloying elements to the basic composition of this alloy, the elements have been found either to lower the corrosion resistance or to decrease the workability of the alloy or a combination of both. For example, the corrosion resistance of the alloy worsens significantly when copper is present at levels of about 1.5% or greater, or manganese is present at levels of about 2% or greater. Silicon, if present, should not exceed about 1% and is preferably maintained at levels less than 1%.

The following examples illustrate a number of specific alloy compositions in accordance with the present invention and compare the corrosion resistance thereof to other known nickel base corrosion resistant alloys. These examples are presented in order to give those skilled in the art a better understanding of the invention, but are not intended to be understood as limiting the invention.

EXAMPLE 1

Developmental heats of several alloy compositions in accordance with the invention were produced by vacuum induction melting 25 to 50 lb. heats from relatively pure, elemental raw materials. Ingots were static cast, homogenized and forged to $\frac{3}{4}''$ square bars. These bars were conditioned as necessary, then hot rolled to approximately $\frac{1}{4}''$ thick. The hot rolled bar was then annealed, conditioned, cold rolled to final size and reannealed. Corrosion test coupons were machined.

The chemical compositions of these alloys are set forth in Table I as alloys A–L. The percentages set forth in Table I are by weight, based on the total composition, and represent the nominal composition, i.e. the amount of each of the elements as weighed for melting.

Cold worked and annealed test specimens of the various alloys, approximately 4 square inches in surface area, were prepared, weighed and subjected to corrosion tests in various test solutions, after which the samples were dried, reweighed and the weight loss in grams was determined and converted to mils per year. Test 1 is a standard test method for determining pitting and crevice corrosion resistance by the use of a ferric chloride solution. The test specimens were immersed in a 10% by weight solution of ferric chloride for 72 hours at 50° C. This test method is similar to ASTM Standard Test Method G 48–76, except that the ASTM test uses 6% by weight ferric chloride. In test 2 the samples are immersed in a boiling aqueous solution of 10% sodium chloride and 5% ferric chloride for 24 hours. Test 3 is a standard test method for detecting susceptibility to intergranular attack in wrought nickel-rich chromium-bearing alloys (ASTM Test Method G 28–72). In this test, the samples are immersed in a boiling ferric sulfate—50% sulfuric acid solution for 24 hours. In test 4 the samples are immersed in boiling 65% nitric acid for 24 hours.

TABLE I

| | NOMINAL COMPOSITION IN WEIGHT PERCENT | | | | | | | | | CORROSION RATE | | | |
|---|---|---|---|---|---|---|---|---|---|---|---|---|---|
| | | | | | | | | | | Test 1 | Test 2 | Test 3 | Test 4 |
| ALLOY | Cr | Mo | W | Ni | C | Ti | Al | Cb | Other | (in grams)* | (in mils per year) | | |
| A*** | 31 | 10 | 2 | Bal. | .02 | .25 | .25 | .40 | — | .0005 | 0.3 | 6.9 | 4.8 |
| B** | 31 | 10 | 4 | " | " | " | " | " | — | .0013 | 38.0 | 8.3 | 6.2 |
| C | 32 | 10 | 2 | " | .01 | .20 | .20 | .20 | — | .0009 | 0.8 | 4.8 | 4.2 |
| D | 31 | 10 | 2 | " | .03 | " | " | " | — | .0000 | 1.3 | 4.7 | 4.5 |
| E** | 32 | 9 | 2 | " | .01 | " | " | " | — | .0001 | 113.6 | 4.7 | 4.1 |
| F*** | 31 | 10 | 2 | " | .02 | .25 | .25 | .40 | — | .0006 | 2.1 | 9.1 | 8.4 |

TABLE I-continued

| ALLOY | NOMINAL COMPOSITION IN WEIGHT PERCENT | | | | | | | | | CORROSION RATE | | | |
|---|---|---|---|---|---|---|---|---|---|---|---|---|---|
| | Cr | Mo | W | Ni | C | Ti | Al | Cb | Other | Test 1 (in grams)* | Test 2 (in mils per year) | Test 3 | Test 4 |
| G | 31 | 10 | 2 | " | " | " | " | " | .10 Mg | .0000 | 1.3 | 8.7 | nt |
| H | 31 | 10 | 2 | " | .01 | .20 | .20 | .20 | 4 Co | .0000 | 0.3 | 8.8 | nt |
| I | 31 | 12 | 2 | " | .03 | " | " | .10 | .025 Zr | .0006 | 0.6 | nt | nt |
| J | 31 | 10 | 2 | " | " | " | " | " | .05 Misch | .0007 | 1.6 | nt | nt |
| K | 31 | 10 | 2 | " | .07 | .70 | .25 | .70 | — | .0007 | 4.0 | 8.7 | nt |
| L | 31 | 10 | 2 | " | .04 | .25 | " | .40 | — | .0010 | 0.7 | 9.0 | nt |
| B-2 | 1 | 28 | — | " | .02 | — | — | — | 2Fe, 1Co | 3.6912 | 1955.8 | 671.0 | nt |
| C-276 | 15.5 | 15.5 | 3.5 | " | .02 | — | — | — | 6Fe, 2Co | .0020 | 4.8 | 221.5 | 242.1 |
| 718 | 19 | 3 | — | " | .04 | 1 | .50 | 5.10 | 19Fe | 1.9569 | 1577.0 | 18.5 | nt |
| 625 | 21.5 | 9 | — | " | .05 | .30 | .30 | 3.6 | 4Fe | .0833 | nt | nt | nt |

Test 1 - 50° C. - 10% $FeCl_3$/72 hrs;
Test 2 - Boiling 10% NaCl + 5% $FeCl_3$/24 hrs;
Test 3 - Boiling 50% Solution of $H_2SO_4$ + $Fe_2(SO_4)_3$/24 hrs;
Test 4 - Boiling 65% $HNO_3$/24 hrs.
nt = not tested
*Constant sample size
**Solution temperature insufficient to dissolve the sigma phase.
***Alloys A and F are identical and the results are within experimental error.

For purposes of comparison, several commercially available corrosion resistant alloys (Alloy B-2, Alloy C-276, Alloy 718, and Alloy 625) were tested in the same manner, and these test results are also set forth in Table I.

These results show the alloy of the present invention to have both superior corrosion resistance and to be more resistant to a broader range of corrosive environments than the commercially available corrosion resistant alloys listed above.

As seen from Table I, the weight percent range for the carbon is 0.01–0.07, for the titanium is 0.2–0.7, for the aluminum is 0.2–0.25 and for the columbium is 0.1 to 0.7.

EXAMPLE 2

Two of the alloys of Example 1 were cold reduced 70% in cross-sectional area on a rolling mill. A sample of Alloy C-276 was similarly reduced. These alloys were then tested in the test solutions, and the results are set forth below in Table II:

TABLE II

| Alloy | Average Weight Loss in Grams | | |
|---|---|---|---|
| | Test 1 | Test 2 | Test 3 |
| F | .0000 | .0020 | .0055 |
| L | .0000 | .0016 | .0101 |
| C-276 | .0008 | .0062 | .1926 |

These tests clearly indicate that the alloy of this invention has a corrosion resistance in the test solutions considerably superior to Alloy C-276 when compared in the cold reduced condition.

EXAMPLE 3

Specimens of two alloys in accordance with the present invention (alloy M and alloy N) were subjected to corrosion studies designed for evaluating performance in corrosive oilfield sour gas well hydrogen sulfide environments (Tests A, B and C) and simulated scrubber environments (Test D). Alloys M and N had a nominal chemical composition as follows: 31% Cr, 10% Mo, 2% W, 0.40% Cb, 0.25% Ti, 0.25% Al, 0.001% max B, 0.10% max Fe, 0.10% max Cu, 0.04% C, 0.015% max S, 0.25% max Co, 0.015% max P, 0.10% max Ta, 0.10% max Zr, 0.10% max Mn, 0.01% max V, 0.25% max Si, balance nickel. Knowing the starting materials used to make these alloys, the aforementioned composition is what one would expect to obtain.

For purposes of comparison, specimens of alloy C-276 were evaluated under similar conditions. All three materials were studied in the 500° F. aged and unaged conditions following unidirectional cold working.

The mechanical properties of the three alloy test specimens are set forth in Table III below.

TABLE III

| Mechanical Properties of Materials Evaluated In Corrosion Studies | 0.2 Percent Offset Yield Strength (ksi) | Tensile Strength (ksi) | Elongation (percent) |
|---|---|---|---|
| Alloy M (the invention) | | | |
| Coldworked | 128.4* | 155.1 | 17.6 |
| (Aged) Coldworked + 500° F./50 hr | 138.9 | 159.1 | 23.4 |
| Alloy N (the invention) | | | |
| Coldworked | 134.0* | 156.6 | 16.8 |
| (Aged) Coldworked + 500° F./50 hr | 136.3 | 160.7 | 17.4 |
| Alloy C-276 (comparison) | | | |
| Coldworked | 168.8 | 203.7 | 17.5 |
| (Aged) Coldworked + 500° F./50 hr | 182.5 | 213.5 | 15.4 |

*Results are within experimental error for such tests for identical compositions.

The three materials were studied in four environments, as follows:

| Test | Aqueous Condition | Temperature |
|---|---|---|
| A - Sulfide Stress Cracking | NACE Solution | 75° F. |
| B - Hydrogen Embrittlement | NACE Solution (Steel couple) | 75° F. |
| C - Hydrogen Embrittlement | 5% $H_2SO_4$ + As (I = 25 mA/cm$^2$) | 75° F. |
| D - Weight-Loss Corrosion | "Green Death" (7% $H_2SO_4$, 3% HCl, 1% $FeCl_3$, 1% $CuCl_3$) | Boiling |

All the embrittlement tests were conducted using 4.375-inch ×0.25-inch×0.094-inch beam specimens stressed in three point bending. The unaged materials were stressed to 80 and 100 percent of their respective yield strengths. Samples which had been aged at 500° F.

for 50 hours were stressed to 100 percent of their yield strength. Unstressed creviced coupons measuring 2-inches×0.625-inch×0.0625-inch were used in the weight-loss corrosion tests. Tests A-C were run for 28 days. The coupons in test D were examined and weighed at the end of 24, 72 and 168 hours.

Test A—Stress Corrosion Cracking in NACE Solution (5 percent NaCl+0.5 percent $CH_3COOH$, Saturated with 100 percent $H_2S$ gas) at 75° F.

Beam specimens stressed to 80 or 100 percent of yield were exposed for 28 days in NACE solution. All specimens were recovered unbroken with no visual signs of corrosion.

Test B—Hydrogen Embrittlement in NACE solution at 75° F.

Beam specimens stressed to 80 or 100 percent of yield strength were fitted with steel couples and placed in NACE solution for 28 days. All the beams were recovered unbroken.

Test C—Hydrogen Embrittlement in 5% $H_2SO_4$+1 mg/l Sodium Arsenite at 75° F.

Nickel-chromium wire was spot welded to the ends of beams stressed to 80 or 100 percent of yield strength. The beam specimens were then placed in the test solution and cathodically charged with hydrogen at a current of 25 mA/cm$^2$. At the end of 13 days, Alloy C-276 in the aged condition stressed at 100 percent of yield was found to have failed. Alloy C-276 in the unaged condition stressed to 100 percent yield strength failed after 21 days. Specimens of alloys M and N were retrieved unbroken at the end of the 28 day test.

Test D—Weight-Loss Corrosion in "Green Death" Solution (Boiling 1% $H_2SO_4$+3% HCl+1% $FeCl_3$+1% $CuCl_3$)

Weight-loss corrosion coupons of each material were weighed, creviced, and placed in the "Green Death" solution. The coupons were cleaned and reweighed at 24 hours, 72 hours, and 168 hours. The corrosion weight loss for the coupons of alloys M and N and the coupons of Alloy C-276, are shown in Table IV.

TABLE IV

| | Corrosion Rate (MPY) | | |
|---|---|---|---|
| | 24 hr | 72 hr | 168 hr |
| Alloy M | .27 | .15 | .7 |
| Alloy N | 0.1 | .3 | .2 |
| Alloy C-276 | .45 | .32 | .42 |

These tests indicate that the performance of the alloy of this invention under simulated oilfield hydrogen sulfide environments at least equals and in some cases is superior to that of alloy C-276 and that the corrosion resistance of the alloy of the invention under conditions of the simulated scrubber environment ("Green Death") test is at least equivalent in this test to that of alloy C-276.

EXAMPLE 4

A series of tests were carried out to investigate the effect of varying amounts of chromium, molybdenum, tungsten, copper and iron on corrosion resistance. The basic alloy composition (Heat No. 367) was as follows: 31% Cr, 10% Mo, 2% W, 0.02% C, 0.25% Ti, 0.25% Al, 0.40% Cb, and balance Ni. For each of the elements chromium, molybdenum, and tungsten, copper and iron heats were prepared with varying amounts of that element while holding all of the other specified elements constant. Test specimens were prepared and tested as in Example 1 under the conditions of the aforementioned test #2 and test #3. The results are shown in Table V.

TABLE V

| HEAT NO. | ELEMENT | % OF ELEMENT | CORROSION RATE (mils per year) Test 2 | Test 3 |
|---|---|---|---|---|
| 367 | Cu | 0 | 0.3 | 6.9 |
| 850 | " | 0.5 | 1.2 | nt |
| 851 | " | 1 | 5.1 | nt |
| 852 | " | 1.5 | 659 | nt |
| 853 | " | 2 | 872 | nt |
| 854 | " | 5 | 1069 | nt |
| 367 | Fe | 0 | 0.3 | 6.9 |
| 821 | " | 0.5 | 1.4 | 12.1 |
| 822 | " | 1.0 | 3.1 | 18.9 |
| 823 | " | 1.5 | 653 | 9.0 |
| 824 | " | 2.0 | 879 | 12.5 |
| 392 | " | 5.0 | 2029 | 6.2 |
| 846 | Cr | 28 | 0.7 | 21.0 |
| 709 | " | 29 | 4.2 | 17.6 |
| 847 | " | 30 | 2.1 | 11.1 |
| 367 | " | 31 | 0.3 | 6.9 |
| 848 | " | 32 | 2.4 | 9.9 |
| 710 | " | 33 | nt | 19.3 |
| 849 | " | 34 | nt* | nt* |
| 842 | Mo | 8 | 389 | 8.6 |
| 843 | " | 9 | 3.5 | 8.5 |
| 367 | " | 10 | 0.3 | 6.9 |
| 844 | " | 11 | 116 | 8.8 |
| 845 | " | 12 | 842 | 15.3 |
| 838 | W | 0 | 27.9 | 18.0 |
| 839 | " | 1 | 1.0 | 21.6 |
| 367 | " | 2 | 0.3 | 6.9 |
| 840 | " | 3 | 2.0 | 8.6 |
| 368 | " | 4 | 8.3 | 38.0 |

nt - not tested
* - unable to test - specimen split due to lack of workability

EXAMPLE 5

It has also been noted that an alloy having the composition, in weight percent, of 31% chromium, 12% molybdenum, 0.2% carbon, 0.25% titanium, 0.25% aluminum, 0.4% columbium with the remainder nickel and containing no tungsten unexpectedly had excellent corrosion resistance to the media in the aforementioned four tests, as follows:

| | CORROSION RATE | | |
|---|---|---|---|
| Test 1 (in grams) | Test 2 | Test 3 (in mils per year) | Test 4 |
| .0007 | 10.7 | 8.5 | 5.2 |

The present invention has been illustrated and described by reference to specific embodiments. However, those skilled in the art will readily understand that modifications and variations may be resorted to without departing from the spirit and scope of the invention.

We claim:

1. An alloy having a high degree of corrosion resistance to each of the highly corrosive oxidizing environments selected from the group consisting of 10% $FeCl_3$ at 50° C. for 72 hours, boiling 10% NaCl+5% $FeCl_3$ solution for 24 hours, boiling 50% solution of $H_2SO_4$+$Fe_2(SO_4)_3$ for 24 hours, and boiling 65% $HNO_3$ for 24 hours, said alloy consisting essentially of, in weight percent, about 27–33% chromium, about 8–12% molybdenum, about 1–4% tungsten and the balance nickel.

2. An alloy having a high degree of corrosion resistance to each of the highly corrosive oxidizing environments selected from the group consisting of 10% $FeCl_3$ at 50° C. for 72 hours, boiling 10% NaCl+5% $FeCl_3$ solution for 24 hours, boiling 50% solution of $H_2SO_4+Fe_2(SO_4)_3$ for 24 hours, and boiling 65% $HNO_3$ for 24 hours, said alloy consisting essentially of, in weight percent, about 29–33% chromium, about 9–11% molybdenum, about 1–3% tungsten and the balance nickel.

3. An alloy having a high degree of corrosion resistance to each of the highly corrosive oxidizing environments selected from the group consisting of 10% $FeCl_3$ at 50° C. for 72 hours, boiling 10% NaCl+5%$FeCl_3$ solution for 24 hours, boiling 50% solution of $H_2SO_4+Fe_2(SO_4)_3$ for 24 hours, and boiling 65% $HNO_3$ for 24 hours, said alloy consisting essentially of, in weight percent, about 31–32% chromium, about 9–10% molybdenum, about 2–3% tungsten and the balance nickel.

4. The alloy as defined in claim 3 wherein said alloy has about 31% chromium, about 10% molybdenum, about 2% tungsten and the remainder nickel.

5. The alloy as defined in claim 1, 2, 3 or 4 wherein said alloy contains at least one element selected from the group of elements set forth below in an amount not to exceed the maximum amount indicated, the total amount of said elements not exceeding about 2%:

| ELEMENT | MAXIMUM AMOUNT (in weight percent) |
|---|---|
| Carbon | 0.15% |
| Titanium | 1% |
| Aluminum | 1% |
| Columbium | 2%. |

6. The alloy as defined in claim 5 wherein said alloy contains at least one element selected from the group of elements set forth below in an amount not to exceed the maximum amount indicated, the total amount of said elements not exceeding about 1%:

| ELEMENT | MAXIMUM AMOUNT (in weight percent) |
|---|---|
| Carbon | 0.08% |
| Titanium | 0.25% |
| Aluminum | 0.25% |
| Columbium | 0.7%. |

7. The alloy as defined in claim 6 consisting essentially of about 31% chromium, about 10% molybdenum, about 2% tungsten, about 0.01–0.07% carbon, about 0.2–0.7% titanium, about 0.2–0.25% aluminum and about 0.1 to 0.7% columbium.

8. An alloy having a high degree of corrosion resistance to each of the highly corrosive oxidizing environments selected from the group consisting of 10% $FeCl_3$ at 50° C. for 72 hours, boiling 10% NaCl+5% $FeCl_3$ solution for 24 hours, boiling 50% solution of $H_2SO_4+Fe_2(SO_4)_3$ for 24 hours, and boiling 65% $HNO_3$ for 24 hours, said alloy consisting of, in weight percent, 31% chromium, 12% molybdenum, 0.02% carbon, 0.25% titanium, 0.25% aluminum, 0.4% columbium and the remainder nickel.

9. An article for deep sour gas well applications or highly corrosive oxidizing environments, said article comprising an alloy consisting essentially of, in weight percent, about 27–33% chromium, about 8–12% molybdenum, about 1–4% tungsten and the balance nickel.

10. The alloy according to claim 1, wherein said alloy further contains no more than about 1.5% iron.

11. The article according to claim 9, wherein said alloy further contains no more than about 1.5% iron.

12. The alloy according to claim 1, wherein said alloy further contains cobalt in an amount not exceeding about 12%.

13. The article according to claim 9, wherein said alloy further contains cobalt in an amount not exceeding about 12%.

14. The alloy according to claim 1, wherein said alloy further contains aluminum in an amount not exceeding about 0.25% and titanium in an amount not exceeding about 0.25%.

15. The article according to claim 9, wherein said alloy further contains aluminum in an amount not exceeding about 0.25% and titanium in an amount not exceeding about 0.25%.

* * * * *